United States Patent [19]

Shugart

[11] 4,322,118

[45] Mar. 30, 1982

[54] STACKABLE BOX BOOK SHELVES

[76] Inventor: Edward S. Shugart, 247 Los Felis, Stockton, Calif. 95210

[21] Appl. No.: 160,313

[22] Filed: Jun. 17, 1980

[51] Int. Cl.[3] ..... A47B 87/00; A47B 77/18; F16B 12/00

[52] U.S. Cl. ..... 312/111; 312/293; 312/306; 211/71

[58] Field of Search ..... 312/111, 293, 306, 308, 312/244, 220, 320, 132, 294; 211/71; 312/201, 206, 202

[56] References Cited

U.S. PATENT DOCUMENTS

| | | | |
|---|---|---|---|
| 136,543 | 3/1873 | Pusey | 312/293 |
| 486,777 | 11/1892 | Harriott | 312/320 |
| 505,030 | 9/1893 | Cox | 312/293 |
| 568,706 | 9/1896 | Shipman | 312/293 |
| 764,832 | 7/1904 | Valentine | 312/220 |
| 2,708,147 | 5/1955 | Duggan et al. | 312/111 |
| 3,287,076 | 11/1966 | Spofford | 312/293 |
| 3,529,878 | 9/1970 | Blowers | 312/111 |
| 3,851,938 | 12/1974 | McCowan et al. | 312/111 |
| 3,869,184 | 3/1975 | Lambert et al. | 312/330 R |
| 4,123,128 | 10/1978 | Abele | 312/244 |
| 4,125,305 | 11/1978 | Kasindorf | 312/233 |
| 4,232,916 | 11/1980 | Correia | 312/111 |

FOREIGN PATENT DOCUMENTS

| | | | |
|---|---|---|---|
| 200399 | 7/1923 | United Kingdom | 312/111 |

*Primary Examiner*—Victor N. Sakran
*Attorney, Agent, or Firm*—Blair, Brown & Kreten

[57] ABSTRACT

Disclosed herein is a container suitably fashioned to serve as a book shelf which is easily stackable and transportable including a six walled container provided with a front wall slidably disposed on said container, a back wall, and a groove running adjacent the back wall along end walls and the bottom wall thereof so that when the container is to be used as a book shelf, the front wall is placed in the groove approximate to the back wall, and when the book shelf is to be used as a container for transporting the books, the front wall is disposed in grooves approximate to a front area of the container so as to contain objects therewithin. Further, these plural containers are provided with interlocking devices for securely interlinking plural such containers.

8 Claims, 3 Drawing Figures

STACKABLE BOX BOOK SHELVES

BACKGROUND OF THE INVENTION

Today's society may be characterized as one in which the various population segments are extremely mobile. The average length of stay in a typical domicile is somewhat less than four years. Accordingly, transporting one's belongings to various locations when moving has become a sophisticated and substantially specialized art. To this end, academicians, students, and others of literary ilk frequently find the need to move from one location to another a burdensome chore since various volumes they have collected over the years provide quite an onus to the moving process. For example students frequently are required to find alternative living accommodations on an annual basis, and other literary types have experienced difficulties in moving valuable reference material from various locations on regular basis.

The following patents appears to reflect those devices most germane to the instant application which inventor is aware, and it should be readily apparent that comparison with these patents when contrasted with the instant application bear only the most remote coincidental structural similarity with that which is claimed in the invention:

U.S. Pat. No. 3,869,184 Lambert et al

U.S. Pat. No. 4,123,128 Abele

U.S. Pat. No. 4,125,305 Kasindorf

Of these references, Abele is believed to provide a structure having the closest proximity to that which is claimed in that it taught therein to provide a container having a plural shelf therewithin for containing pies or the like in which a front wall thereof is capable of vertical displacement so as to gain access to plural pies contained therewithin. Further, handle means are provided in order to make the pie case more readily transportable.

By way of contrast, it should be appreciated that this device is not readily capable of providing plural such containers in a stack fashioned for semi-permanent deployment in a site, and further in order to provide access at all times to the contents within the container, a storage problem exists once the front wall has been removed.

SUMMARY AND OBJECTS OF THE INVENTION

Accordingly, this invention has an object to provide a container suitable for storing books and similar object which has a slideable front wall and an area approximate to the back wall which can contain the front wall when removed so as to provide an open container.

It is a further object of this invention to provide a device with the character described above in which the front wall is readily removable, readily storable approximate to the back wall, and access to the front wall is facile and of elegant design.

It is a further object of this invention to provide a device with the character described above which is easy to transport, readily nestable when plural containers are to be used, durable in construction, and relatively easy to manufacture.

It is yet a further object of this invention to provide a device with the character described above which is pleasing in appearance so that the container motif will be compatible with most types of decor.

These and other objects will be made manifest by providing a container of the character described above formed from six walls including a front wall slidably disposed on the container, a back wall spaced from a top wall and end and bottom walls having grooves thereon approximate to the back wall for slideable insertion therein of the front wall. Further, other objects will be made manifest when considering the following detailed specification when taken in conjunction with the appended drawing figures.

BRIEF DESCRIPTION OF THE PREFERRED EMBODIMENTS

Figure 1:
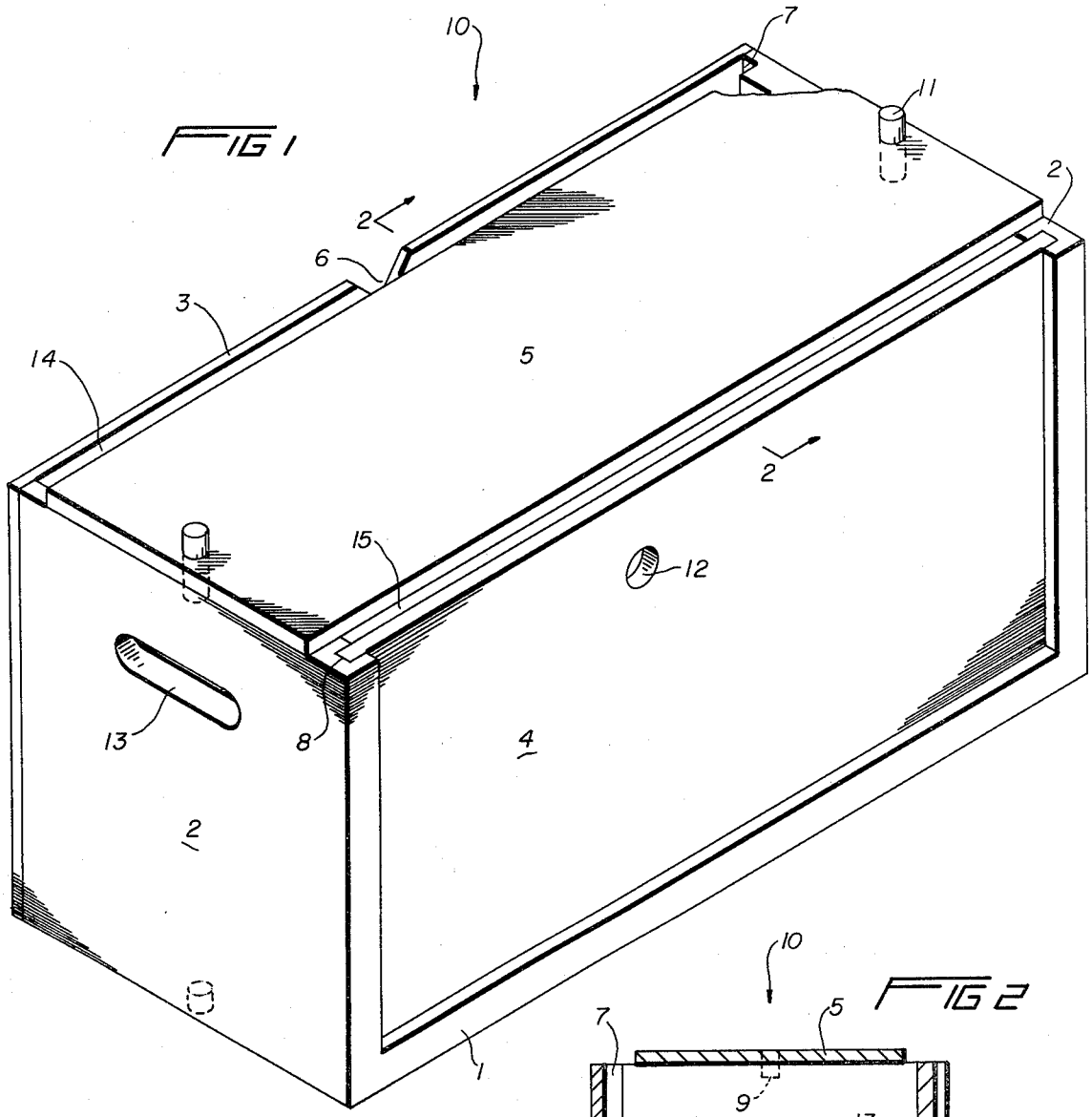
FIG. 1 is a perspective view of the container according to the present invention.
Figure 2:
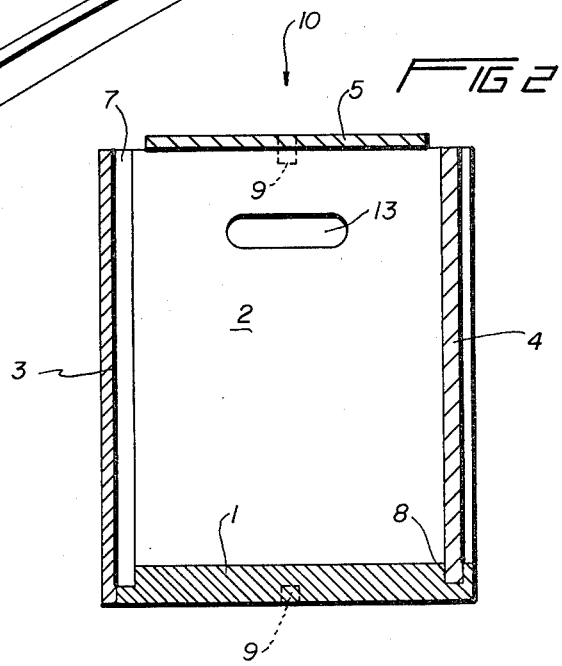
FIG. 2 is a sectional view taken along lines 2—2 of FIG. 1.
Figure 3:
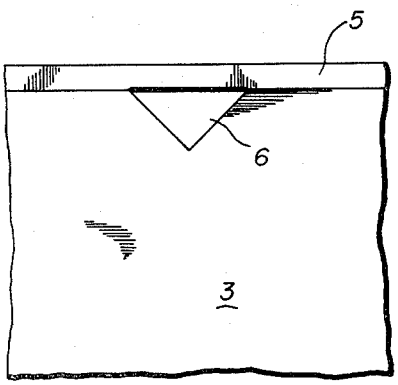
FIG. 3 is a fragmentary view of the back wall showing the details for the ready removal of the front wall when placed in approximate relation to the back wall.

Referring to the drawings now, wherein like reference numerals refer to like parts throughout the various drawing figures, reference numeral 10 is directed to the container according to the present invention.

This container which is suitable for storing books and the like is formed of a six wall box including a front wall 4 slideably disposed within grooves 8 carried on end walls 2. Further, a bottom wall 1 is provided with first and second grooves, the second groove which allows slideable insertion therein of the front wall 4 towards the front face of the container. A first groove 7 extending along the end walls 2 near the rearward portion of the contain coact with a further groove on the bottom face of the container so that should it be desired the front wall 4 can be slideably removed from the front face of the container and slideably disposed within the grooved area near the back of the box. The disposition of the grooves near the back of the box is such that the front wall will be in substantial tangential registry with the rear wall 3 when thus deployed.

To further facilitate the slideable insertion of the front wall 4 either in the front portion of the container or the rear portion, the top wall 5 is provided with slots 14 and 15 which allow access to the grooves as clearly shown in the drawings.

Once the front wall is placed adjacent the back wall, the removable insertion thereof is facilitated by means of a notch 6 disposed in a preferred form along an essential top edge of the back wall, and this notch has the form of a V in one embodiment. Further, a finger hole 12 is provided on a top edge of the front wall adapted to register with the notch 6 on the back wall for facilitating translation of the front wall 4.

Plural such containers 10 can be easily nested one on top of the other by means of the following arrangement:

holes are provided on the top wall 5 of the container, and recesses are provided in the end walls 2, these recesses bearing legend 9.

dowels 11 are provided to extend through the top wall and into the recesses 9 and portions thereof are allowed to extend outwardly therefrom so that an overlying or underlying container can coact in the recess with the dowel for rigid attachment of plural such containers so as to form a shelfing matrix or array.

When it is desired to transport these containers, the front wall 4 is removed from its approximate position to rear wall 3 and disposed within the grooves 8 provided on the end and bottom walls toward the front face thereof and hand grips 13 are provided on the end walls so that the containers can be transported to another site.

Having thus described the invention, it should be apparent that numerous structural modifications are contemplated as being a part of this invention as set forth hereinabove and as defined hereandbelow by the claims.

What is claimed is:

1. A container suitable for storing books and the like comprising, in combination:

a six walled container including a front wall slideably disposed on said container, a back wall, and storage means for holding said front wall adjacent said back wall when contents within said container are to be displayed including a first groove inwardly provided on bottom and end walls of said container adjacent to said back wall and an open slot substantially the thickness of said front wall between said back wall and a top wall, whereby said front wall can be slideably positioned therein.

2. The device of claim 1 further comprising nesting means on said top and bottom walls of said container.

3. The device of claim 2 wherein said container includes handle means for transporting said container.

4. The device of claim 3 including grasping means to facilitate manipulation of said front wall.

5. The device of claim 4 wherein said grasping means comprises a cutout on a top edge of said back wall and a finger hole on a top portion of said front wall, in substantial registry with said cutout.

6. The device of claim 5 wherein said nesting means comprises recesses on said end walls and holes provided on said top and bottom walls, and dowel pins adapted to extend through said holes and into said recesses so that plural containers can be stacked with said dowels interlocking said containers.

7. The device of claim 6 wherein said handle means comprises ovaloid openings on top portions of said side walls.

8. The device of claim 7 wherein said front wall slides in second grooves provided on end and bottom walls on a front area of said container, and an open area is provided on said top wall to allow said front wall access to said second groove.

* * * * *